US011767714B2

(12) United States Patent
Codling et al.

(10) Patent No.: US 11,767,714 B2
(45) Date of Patent: Sep. 26, 2023

(54) BOUNDARY LINE GENERATION FOR CONTROLLING DRILLING OPERATIONS

(71) Applicant: Landmark Graphics Corporation, Houston, TX (US)

(72) Inventors: Jeremy Codling, Stafford (GB); Shang Zhang, Fulshear, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 240 days.

(21) Appl. No.: 17/132,727

(22) Filed: Dec. 23, 2020

(65) Prior Publication Data

US 2022/0195804 A1 Jun. 23, 2022

(51) Int. Cl.

| | |
|---|---|
| ***E21B 7/04*** | (2006.01) |
| ***E21B 7/10*** | (2006.01) |
| ***E21B 47/04*** | (2012.01) |
| ***E21B 47/08*** | (2012.01) |
| ***E21B 47/022*** | (2012.01) |

(52) U.S. Cl.

CPC ..... *E21B 7/10* (2013.01); *E21B 47/022* (2013.01); *E21B 47/04* (2013.01); *E21B 47/08* (2013.01)

(58) Field of Classification Search

CPC ..... E21B 7/10; E21B 47/022; E21B 47/04; E21B 47/08

See application file for complete search history.

(56) References Cited

U.S. PATENT DOCUMENTS

| | | | | |
|---|---|---|---|---|
| 9,388,682 | B2 | 7/2016 | Tilke | |
| 2002/0044498 | A1* | 4/2002 | Krebs | G01V 1/286 367/27 |
| 2010/0169018 | A1 | 7/2010 | Brooks | |
| 2016/0090822 | A1* | 3/2016 | Lu | E21B 7/10 703/1 |
| 2016/0102544 | A1 | 4/2016 | Aklestad et al. | |
| 2016/0230537 | A1* | 8/2016 | Stockhausen | E21B 47/026 |
| 2019/0257189 | A1* | 8/2019 | Bang | E21B 47/09 |

(Continued)

FOREIGN PATENT DOCUMENTS

| | | |
|---|---|---|
| CN | 110593852 | 12/2019 |

OTHER PUBLICATIONS

Britton et al., "Anti-Collision Best Practices Developed for Horizontal Drilling Across Pre-Existing Horizontal Wellbores", SPE-189612-MS, presented at the IADC/SPE Drilling Conference and Exhibition, Fort Worth, TX, Mar. 6, 2018, 9 pages.

(Continued)

*Primary Examiner* — Kyle R Quigley
*Assistant Examiner* — Christine Y Liao
(74) *Attorney, Agent, or Firm* — Kilpatrick Townsend & Stockton LLP

(57) ABSTRACT

A system can generate and output boundary lines for controlling a drilling operation. The system can receive data, including an offset well surveys, measuring instrument information, and a well casing diameter, about offset wells in a subterranean formation. The system can determine reference well values. The system can generate boundary lines for the offset wells based on the received data and the calculated reference well values. The system can adjust the boundary lines, and can output the adjusted boundary lines for controlling a drilling operation.

20 Claims, 6 Drawing Sheets

(56) References Cited

U.S. PATENT DOCUMENTS

2019/0376379 A1 12/2019 Ramjit et al.
2020/0256181 A1* 8/2020 Jamieson ..... E21B 44/02

OTHER PUBLICATIONS

Poedjono et al., "Anti-Collision Risk Management Standard for Well Placement", SPE 121040, presented at the 2009 SPE Americas E&P Environmental & Safety Conference, San Antonio, TX, Mar. 23, 2009, 23 pages.
Zhang et al., "A New Method of Anti-Collision while Drilling based on Radial Gradient Measurement", ARMA 19-114, presented at the 53rd US Rock Mechanics/Geomechanics Symposium, New York, NY, Jun. 23, 2019, 7 pages.
PCT Application No. PCT/US2020/067123, "International Search Report and Written Opinion", dated Sep. 10, 2021, 10 pages.

* cited by examiner

BOUNDARY LINE GENERATION FOR CONTROLLING DRILLING OPERATIONS

TECHNICAL FIELD

The present disclosure relates generally to wellbore drilling operations and, more particularly (although not necessarily exclusively), to generating and outputting boundary lines for controlling wellbore drilling operations.

BACKGROUND

A drilling operation may involve forming a wellbore in a subterranean formation. The wellbore may be formed in close proximity to offset wells that are existing wells in the subterranean formation. The offset wells may include a number of wellbores with complex trajectories in dense arrangements in the subterranean formation. One objective of the drilling operation may include forming the wellbore while avoiding collisions with offset wells. A collision between the wellbore and at least one offset well may cause catastrophic consequences that can include economic losses, loss of life, and the like. Pre-drilling planning may help avoid collisions, but once the drilling operation commences, drilling trajectories and downhole conditions can change such that the drilling operation may not rely on the pre-drilling planning to successfully form the wellbore in the subterranean formation.

DETAILED DESCRIPTION

Figure 1:
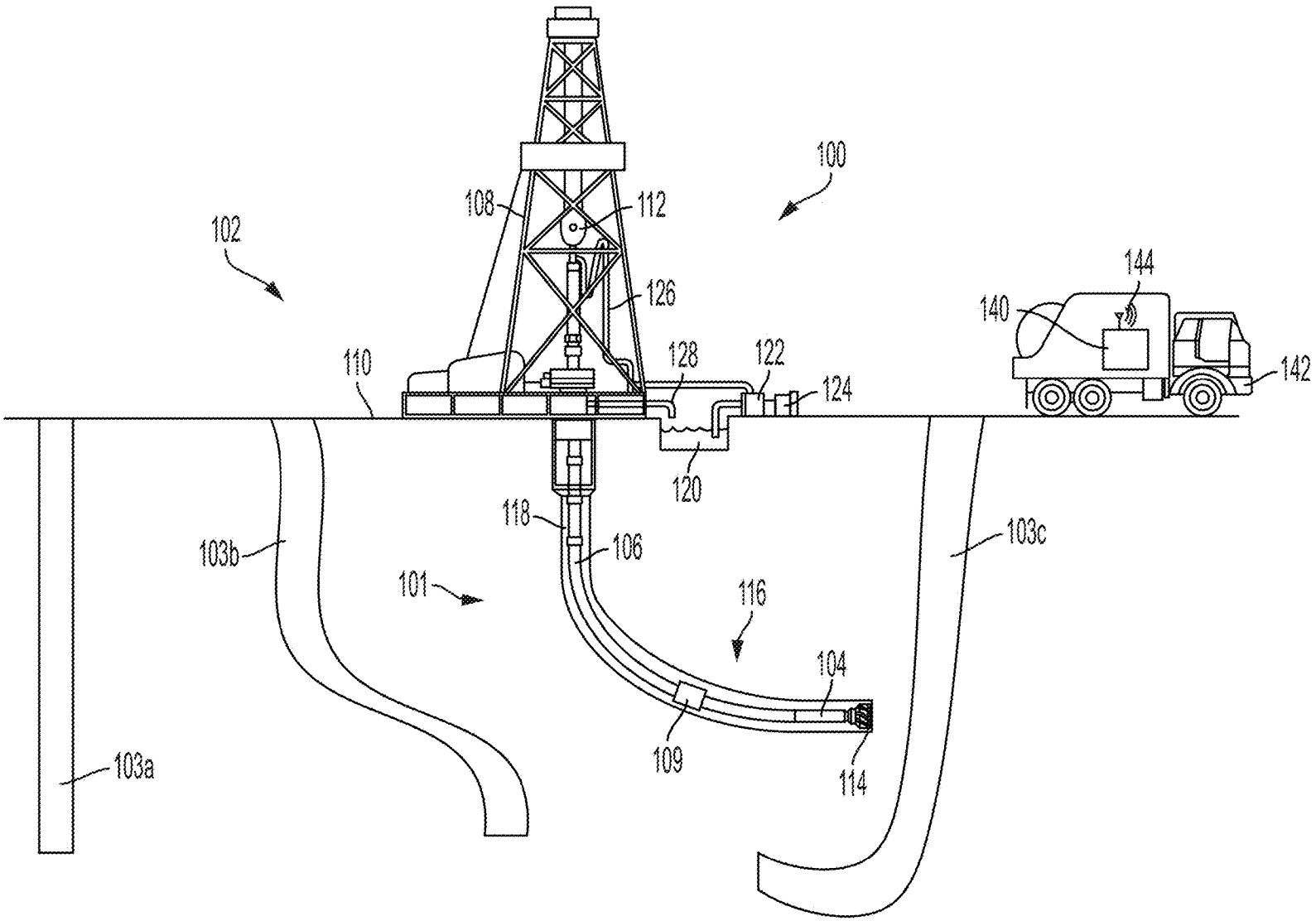
FIG. 1 is a cross-sectional view of a wellbore-drilling system that is forming a reference well near offset wells in a subterranean formation according to one example of the present disclosure.

Certain aspects and examples of the present disclosure relate to automatically generating and outputting boundary lines for controlling a drilling operation. The drilling operation may involve drilling or otherwise forming a wellbore in a subterranean formation that may include a set of offset, or existing, wells. The boundary lines may be generated by a computing device and may be used to control a drilling operation such that the drilling operation forms the wellbore within the boundary lines. For example, while forming the wellbore, the boundary lines may be used to adjust a trajectory of the drilling operation to ensure the wellbore is formed within the boundary lines. The computing device may be configured to generate the boundary lines automatically such that, as the drilling operation progresses, the computing device generates the boundary lines without additional user input. The computing device may generate the boundary lines based on data about the offset wells and based on reference well values. The data about the offset wells may include well surveys, measuring instrument information, well casing diameters, and other suitable data. The reference well values may represent values relating to the wellbore being formed and may include a center-to-center distance, at least one tool-face angle, a reference-well casing diameter, a survey uncertainty, and the like.

With recent development of directional drilling technologies, regulatory changes, and economic conditions in the hydrocarbon industry, more wells may be drilled close to each other and may include complex wellbore trajectories. In order to effectively develop new fields or new wells in existing fields, complex drilling plans in a crowded downhole condition with an abundance of existing wells may be used. The complex drilling plans may introduce higher risk of incidents during drilling operation. The new well may be drilled greater than a certain distance of adjacent wells based on a user anti-collision policy. But, due to various factors, such as measurement errors, formation conditions, and tool accuracy, etc., uncertainties may exist during the operation that may lead to a collision with existing wells. Thus, collision avoidance while drilling may be important for safely executing the drilling operation. Collision avoidance can be achieved by automatically generating boundary lines for helping directional drillers and automated steering processes drill the well safely and effectively.

An effective and robust method can be used to track a reference well, or the well being drilled, against the plan and avoid offset wells. In drilling operations, a set of boundaries can be generated around the reference well in travelling cylinder plots. The drilling survey may remain inside the boundaries to avoid interference with existing wellbores. The boundary may also be a target boundary (or driller's target). Thus, directional drillers may, in addition to avoiding interference, be able to keep the wellbore on track. For a certain interval of measured depth, the boundary of the interval can be calculated based on relative uncertainty ellipses of offset wells. During the drilling process, the reference well may be drilled without continuously correcting the wellbore trajectory. A tapering feature may be used that looks ahead on the planned trajectory for sudden high angle intersections and targets. The tapering feature may use a cone based on the directional drilling technique to deviate the well-path before an obstacle. Vertical wells can be anticipated when drilling horizontal wells through the vertical wells. A smoothing feature can be used that can smooth the boundaries to prevent sudden jumps to an edge of the radius. An erratic collision-avoidance shape may not function for the directional driller given the imprecise nature of directional control over short intervals.

In drilling operations, the wellbore trajectory can be calculated from the survey measurement. Various algorithms may be available for the survey calculated. The calculated trajectory may not be identical to the actual trajectory. Additionally, due to errors from measurement tools, the survey stations may not be accurate. Thus, a certain tolerance range may be maintained in order to drill safely. The drilling survey may not be identical to the planned survey due to control and geological variations but, instead, may be similar to the planned survey. It may not be practical or economical to continuously adjust the course during drilling in order to exactly match the planned wellbore trajectory. A boundary that the trajectory is accepted within may be determined and the course may be infrequently adjusted during the drilling operation. Traveling cylinder plots may be used such that, instead of plotting the whole wellbore trajectory, the reference well may be analyzed by intervals. A series of drilling boundaries can be calculated and plotted on a tool-face angle plot along the reference wellbore.

The reference well, while being drilling, may not interfere or collide with the offset wells. Due to uncertainty, an error ellipse can be calculated around the offset wells. The error ellipse can be a relative ellipse that additionally considers the uncertainty in the reference well. By connecting the ellipses, a smooth, closed-loop drilling boundary can be generated. Targets can additionally form a drilling boundary. Wellbore surveys may stay within the target boundary in order to achieve the target or to achieve the reference well trajectory as planned. The center of the tool-face angle plot can be the planned trajectory. If the drilling survey shows that the reference well is getting close to the edge of the drilling boundary, the drilling engineers may adjust the course to ensure the reference well moves toward the center of the boundary so that the reference well does not interfere with offset wells or otherwise miss the target. A level of warning may be implemented for alerting drilling engineers of a non-satisfactory reference wellbore trajectory.

In addition to analyzing the drilling boundary for current interval, a projection of the drilling boundary ahead of the drill bit can be performed. The projection may ensure that objects between intervals are not ignored. For example, if there is a vertical well between two intervals of a horizontal well that is being drilled, without the project-ahead feature, the driller may only see the vertical well when the horizontal well is about to collide with the vertical well, which may result in collision. But, with the project-ahead feature, the current interval drilling boundary can be modified accordingly based on the information ahead of the bit. The driller can see the vertical well approaching and can adjust the wellbore trajectory before collision.

The described functions can include real-time applications to provide analysis in substantially real-time. Automatic drilling control systems can be integrated to provide a robust drilling automation solution. The functions can be combined with artificial intelligent algorithms to provide smart decisions for drillers or automated drilling systems. With similar off-set well info, the functions can be combined with machine learning algorithms to provide human-like decisions from statistical analysis. In another example, a drilling operation can include monitoring the drilling process and certain aspects of the functions can be used to control a monitoring process for the drilling operation.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore-drilling system 100 that is forming a reference well 101 near offset wells 103*a-c* in a subterranean formation 102 according to one example of the present disclosure. As illustrated in FIG. 1, there are three offset wells 103, but other suitable numbers of offset wells 103 can exist in the subterranean formation 102. A wellbore 118 for extracting hydrocarbons may be created by drilling into a subterranean formation 102 using the wellbore-drilling system 100. The wellbore-drilling system 100 may drive a bottom hole assembly (BHA) 104 positioned or otherwise arranged at the bottom of a drill-string 106 extended into the subterranean formation 102 from a derrick 108 arranged at the surface 110. The derrick 108 includes a kelly 112 used to lower and raise the drill-string 106. The BHA 104 may include a drill bit 114 operatively coupled to a tool string 116, which may be moved axially within a drilled wellbore 118 as attached to the drill-string 106. The combination of any support structure (in this example, the derrick 108), any motors, electrical equipment, and support for the drill-string and tool string may be referred to herein as a drilling arrangement.

During the drilling operation, the drill bit 114 may penetrate the subterranean formation 102 to create the wellbore 118. The BHA 104 can provide control of the drill bit 114 as the drill bit 114 advances into the subterranean formation 102. The combination of the BHA 104 and the drill bit 114 can be referred to as a drilling tool. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill-string 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drill-string 106, and hole cleaning can occur which involves returning the drill cuttings and debris to the surface. The cuttings and mud mixture are passed through a flow line 128 and are processed such that a cleaned mud is returned down hole through the stand pipe 126 once again.

The drilling arrangement and any sensors (through the drilling arrangement or directly) may be communicatively coupled to a computing device 140. The computing device 140 may be configured to generate, adjust, and output boundary lines for controlling the drilling operation. In FIG. 1, the computing device 140 is illustrated as being deployed in a work vehicle 142; however, a computing device to generate the boundary lines and to control the drill bit 114 or the drilling operation can be permanently installed with the drilling arrangement, be hand-held, or be remotely located. Although one computing device 140 is depicted in FIG. 1, in other examples, more than one computing device can be used, and together, the multiple computing devices can perform operations, such as those described in the present disclosure.

The computing device 140 can be positioned belowground, aboveground, onsite, in a vehicle, offsite, etc. The computing device 140 can include a communication device 144. The communication device 144 can represent one or more of any components that facilitate a network connection. In the example shown in FIG. 1, the communication device 144 is wireless and can include wireless interfaces such as IEEE 802.11, Bluetooth™, or radio interfaces for accessing cellular telephone networks (e.g., transceiver/antenna for accessing a CDMA, GSM, UMTS, or other mobile communications network). In some examples, the communication device 144 can use acoustic waves, surface waves, vibrations, optical waves, or induction (e.g., magnetic induction) for engaging in wireless communications. In other examples, the communication device 144 can be wired and can include interfaces such as Ethernet, USB, IEEE 1394, or a fiber optic interface. In an example with at least one other computing device, the computing device 140 can receive wired or wireless communications from the other computing device and perform one or more tasks based on the communications.

Figure 2:
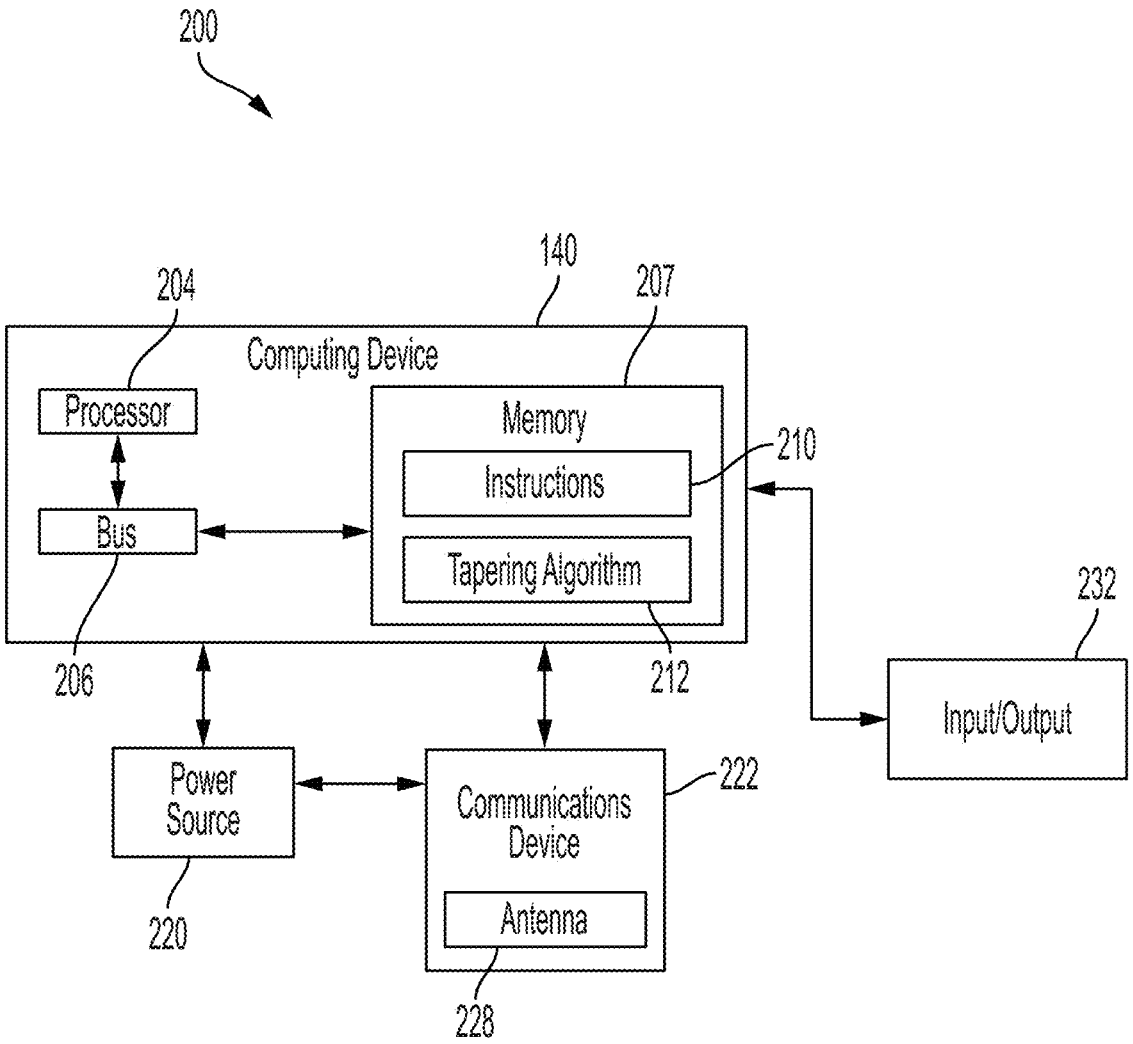
FIG. 2 is a block diagram of a computing system for automatically generating and outputting boundary lines to control a drilling operation according to one example of the present disclosure.

FIG. 2 is a block diagram of a computing system 200 for automatically generating and outputting boundary lines to control a drilling operation according to one example of the present disclosure. The components shown in FIG. 2 (e.g. the computing device 140, power source 220, etc.) can be integrated into a single structure. For example, the components can be within a single housing. In other examples, the components shown in FIG. 2 can be distributed via separate housings or otherwise, and in electrical communication with each other.

The system 200 may include the computing device 140. The computing device 140 can include a processor 204 interfaced with other hardware via a bus 206. A memory 207, which can include any suitable tangible (and non-transitory) computer-readable medium, such as random-access memory ("RAM"), read-only memory ("ROM"), electrically erasable and programmable read-only memory ("EEPROM"), or the like, can include program components that configure operation of the computing device 140. In some aspects, the computing device 140 can include input/output interface components (e.g., a display, printer, keyboard, touch-sensitive surface, and mouse) and additional storage.

The processor 204 can execute one or more operations, included in instructions 210 stored in the memory 207, for automatically generating boundary lines to control a drilling operation. For example, the processor 204 can generate and adjust the boundary lines using received data about offset wells in the subterranean formation and determined reference well values about the reference well 101. The memory 207 may additionally include a tapering algorithm 212 that can be used by the computing device 140 to adjust the boundary lines. The instructions 210 may include other suitable instructions for automatically generating and outputting boundary lines to control the drilling operation. The processor 204 can execute the instructions 210 stored in the memory 207 to perform the operations. The processor 204 can include one processing device or multiple processing devices or cores. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The memory 207 may be non-volatile and may include suitable types of memory devices that retain stored information when powered off. Non-limiting examples of the memory 207 include EEPROM, flash memory, or other suitable types of non-volatile memory. In some examples, at least part of the memory 207 can include a medium from which the processor 204 can read instructions. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The computing system 200 can include a power source 220. The power source 220 can be in electrical communication with the computing device 140 that may include a communications device 222. In some examples, the power source 220 can include a battery or an electrical cable (e.g., a wireline). The power source 220 can include an AC signal generator. The computing device 140 can operate the power source 220 to apply a transmission signal to an antenna 228, in an example in which the communications device 222 is operating in a wireless mode, to forward data relating to the subterranean formation 102, etc. to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, part of the communications device 222 can be implemented in software. For example, the communications device 222 can include additional instructions stored in memory 207 for controlling functions of the communications device 222. The communications device 222 can receive signals from remote devices and transmit data to remote devices. For example, the communications device 222 can transmit wireless communications that are modulated by data via the antenna 228. In some examples, the communications device 222 can receive signals (e.g. associated with data to be transmitted) from the processor 204 and amplify, filter, modulate, frequency shift, or otherwise manipulate the signals. In some examples, the communications device 222 can transmit the manipulated signals to the antenna 228. The antenna 228 can receive the manipulated signals and responsively generate wireless communications that carry the data.

The computing system 200 can additionally include an input/output interface 232. The input/output interface 232 can connect to a keyboard, pointing device, display, and other suitable computer input/output devices. An operator may provide input using the input/output interface 232. Additionally or alternatively, the operator may view outputs from the computing device 140 on the input/output interface 232. The boundary lines may be displayed to the operator on the input/output interface 232. The displayed boundary lines can provide an advisory function to the operator, or to the supervisor, of an operation using the computing system 200, either of whom can make adjustments to the drilling operation based on the displayed boundary lines. The computing device 140 may automatically generate and output the boundary lines during the drilling operation at different drilling intervals in which the computing device 140 generates the boundary lines without input from the operator or the supervisor. But, in some examples, the operator or supervisor may adjust the drilling operation based on viewing the automatically generated and displayed boundary lines.

Figure 3:
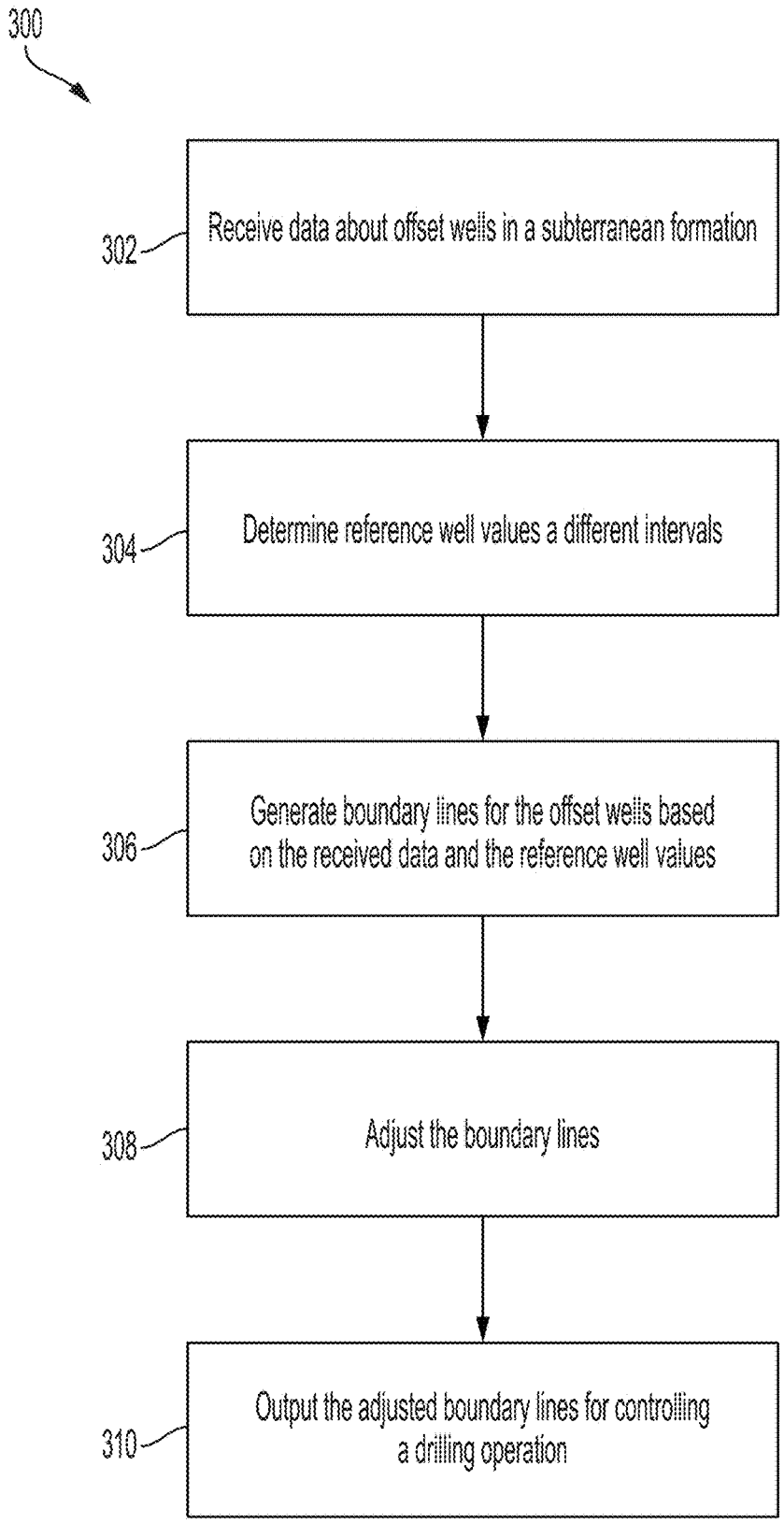
FIG. 3 is a flowchart of a process for automatically generating and outputting boundary lines for controlling a drilling operation according to one example of the present disclosure.

FIG. 3 is a flowchart of a process 300 for automatically generating and outputting boundary lines for controlling a drilling operation according to one example of the present disclosure. At block 302, the computing device 140 receives data about a set of offset wells 103 in the subterranean formation 102. The set of offset wells 103 may include suitable numbers of offset wells 103 for the subterranean formation 102. The data may include well surveys, measuring instrument information, a well casing diameter, and other suitable data relating to the offset wells 103. The measuring instrument information may include information about uncertainty values relating to the measuring instrument. In some examples, the measuring instrument may be used to perform the offset well surveys. The computing device 140 may receive the data via user input from the operator or supervisor of the drilling operation. In some examples, the computing device 140 may receive the data by accessing a geological-historical database that includes the data.

At block 304, the computing device 140 determines reference well values at different drilling intervals. The reference well values may relate to the reference well 101 that is being formed by the drilling operation. The drilling intervals may be drilling intervals along a trajectory of the reference well 101 and may include depth intervals, and the size of the drilling intervals may include suitable sizes for determining the reference well values. In other examples, the different intervals may include time intervals. In an example drilling operation, the drilling intervals can be 100-foot depth intervals in which reference well values are determined for each 100-foot depth interval in the example drilling operation. The reference well values may include values relating to the reference well 101 including a center-to-center distance, at least one tool-face angle, a reference-well casing diameter, and a survey uncertainty. The center-to-center distance may represent a distance between the center of a certain offset well 103 and the center of the reference well 101. The tool-face angle may be an angle of the drill bit 114 of the drilling operation.

At block 306, the computing device 140 generates the boundary lines based on the received data and the reference well values. The computing device 140 may calculate or otherwise generate the boundary lines at the different drilling intervals. In some examples, for each drilling interval in the different drilling intervals, the computing device 140 may generate the boundary lines using the received data and the reference well values in the respective drilling interval. The computing device 140 may calculate or otherwise determine an error ellipse for each offset well 103 in the different drilling intervals. The error ellipse can be an area within which the drilling operation avoids forming the reference well 101. In some examples, the error ellipse may include a radius around the respective offset well 103, and the radius can be determined by the computing device 140 via user input or other suitable manners. In these examples, after determining the radii, the computing device 140 may adjust the error ellipses based on the measuring instrument uncertainty or other suitable methods.

Subsequent to determining the error ellipse for each offset well 103, the computing device 140 may generate the boundary lines by concatenating or otherwise combining error ellipses of the offset wells 103. In some examples, the error ellipses may overlap in which case the boundary lines may form a shape that is a combination of the error ellipses. In other examples, the error ellipses may not overlap in which case the boundary lines may not form a shape and, instead, may contain the error ellipses. In yet other examples, the computing device 140 may additionally use a level of acceptable risk designated by a user to determine the boundary lines. The computing device 140 may be configured to generate the boundary lines automatically such that, as the drilling operation progresses, the computing device 140 generates the boundary lines without additional user input.

At block 308, the computing device 140 adjusts the boundary lines. The computing device 140 may use one or more algorithms to adjust the boundary lines, and the algorithms may include a smoothing algorithm, a tapering algorithm 212, and other suitable algorithms for adjusting the boundary lines. The computing device 140 may execute the smoothing algorithm for eliminating sharp corners in the boundary lines. In some examples, the boundary lines may include sharp corners that include angles above a pre-set angle value and that are not within a pre-set distance from an offset well 103. The pre-set angle value and the pre-set distance may be determined by the computing device 140 via user input or in other suitable manners for determining the pre-set angle value and the pre-set distance. The smoothing algorithm may eliminate the sharp corners by replacing the sharp corners with smooth, continuous arcs. Additionally, the computing device 140 may execute the tapering algorithm 212 for anticipating newly detected offset wells 103 in subsequent drilling intervals. The tapering algorithm 212 is described in detail with respect to FIG. 4.

At block 310, the computing device 140 outputs the adjusted boundary lines for controlling the drilling operation. The computing device 140 may use the output, adjusted boundary lines as input to control equipment of the drilling operation. For example, based on the output, adjusted boundary lines, the computing device 140 may adjust a trajectory or a speed of the drill bit 114. In other examples, the trajectory of the drilling operation may be within the output, adjusted boundary lines. In this example, the computing device 140 may not adjust the drilling operation and, instead, may proceed to the subsequent drilling interval.

Figure 4:
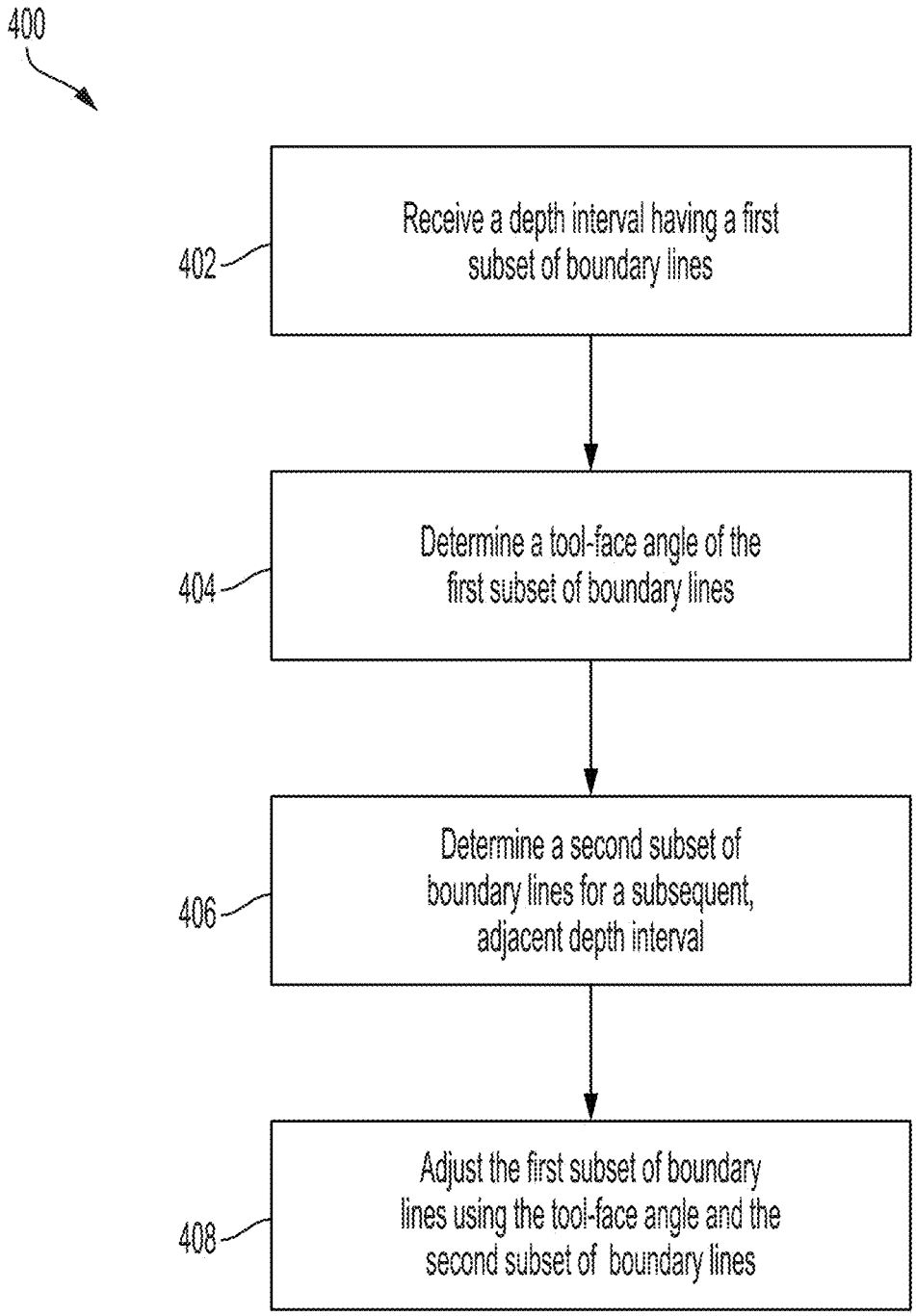
FIG. 4 is a flowchart of a process for executing a tapering algorithm on drilling boundary lines that may control a drilling operation according to one example of the present disclosure.

FIG. 4 is a flowchart of a process 400 for executing a tapering algorithm 212 on drilling boundary lines that may control a drilling operation according to one example of the present disclosure. At block 402, the computing device 140 receives a depth interval that includes a first subset of boundary lines. The depth interval may be included in the different intervals described with respect to the block 302 of the process 300. The depth interval may be one of a plurality of depth intervals included in the drilling operation. The first subset of boundary lines may be included in the boundary lines that are determined at the block 306 of the process 300. The depth interval may be a suitable size for executing the tapering algorithm 212.

At block 404, the computing device 140 determines a tool-face angle associated with the first subset of boundary lines. The tool-face angle may be a reference well value, and as such, the computing device 140 may determine the tool-face angle at the block 304 of the process 300. In some examples, the tool-face angle includes an angle at which the drilling operation is forming the wellbore using the drill bit 114. In some examples, more than one tool-face angle may be determined for the depth interval. In these examples, an average of the tool-face angles can be used, or, in other examples, the largest tool-face angle may be used.

At block 406, the computing device 140 determines a second subset of boundary lines for a subsequent, adjacent depth interval. For example, if the depth interval received at the block 402 is at a depth of 4800 feet and the depth interval includes a size of 200 feet, then the subsequent, adjacent depth interval is at 5000 feet. The computing device 140 may determine the second subset of boundary lines based on projected conditions for the subsequent, adjacent depth interval. The projected conditions may include locations for the offset wells 103 that are different from the locations for the offset wells 103 at the received depth interval. Additionally or alternatively, previously undetected offset wells 103 may be identified at the subsequent, adjacent depth interval. The previously undetected offset wells 103 may be anticipated through use of the tapering algorithm 212, and, as such, some collisions may be avoided by using the tapering algorithm 212.

At block 408, the computing device 140 adjusts the first subset of boundary lines based on the tool-face angle determined at the block 404 and the second subset of boundary lines. The computing device 140 may additionally or alternatively use a predetermined percentage, uncertainty values, and the like for adjusting the first subset of boundary lines. The predetermined percentage may be determined by the tool-face angle. Additionally or alternatively, the predetermined percentage may be determined using the size of the depth interval, user input, a combination thereof, or by other suitable methods. The uncertainty values may include uncertainty values of measuring tools associated with the offset wells 103, and the like. The computing device 140 may overlay the first subset of boundary lines and the second subset of boundary lines to factor the second subset of boundary lines into the first subset of boundary lines. For example, the computing device 140 may combine the first subset of boundary lines and the second subset of boundary lines, and the computing device 140 may adjust the first subset of boundary lines to be an area occupied by both the first subset of boundary lines and the second subset of boundary lines. In some examples, the computing device 140 may increase the second subset of boundary lines by the predetermined percentage for determining whether previously unidentified offset wells 103 exist near the reference well 101. The computing device 140 may overlay the increased second subset of boundary lines on the first subset of boundary lines for adjusting the first subset of boundary lines to anticipate newly detected offset wells 103 to reduce risk of collisions between the reference well 101 and at least one offset well 103.

Figure 5B:
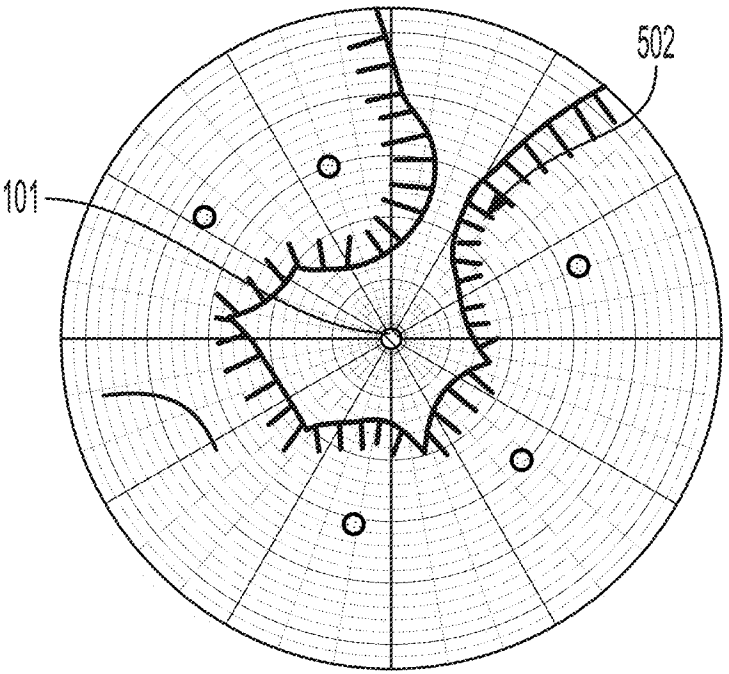
FIG. 5B is an example of boundary lines automatically generated, based on the error ellipses, for a reference well in the subterranean formation according to one example of the present disclosure.
Figure 5A:
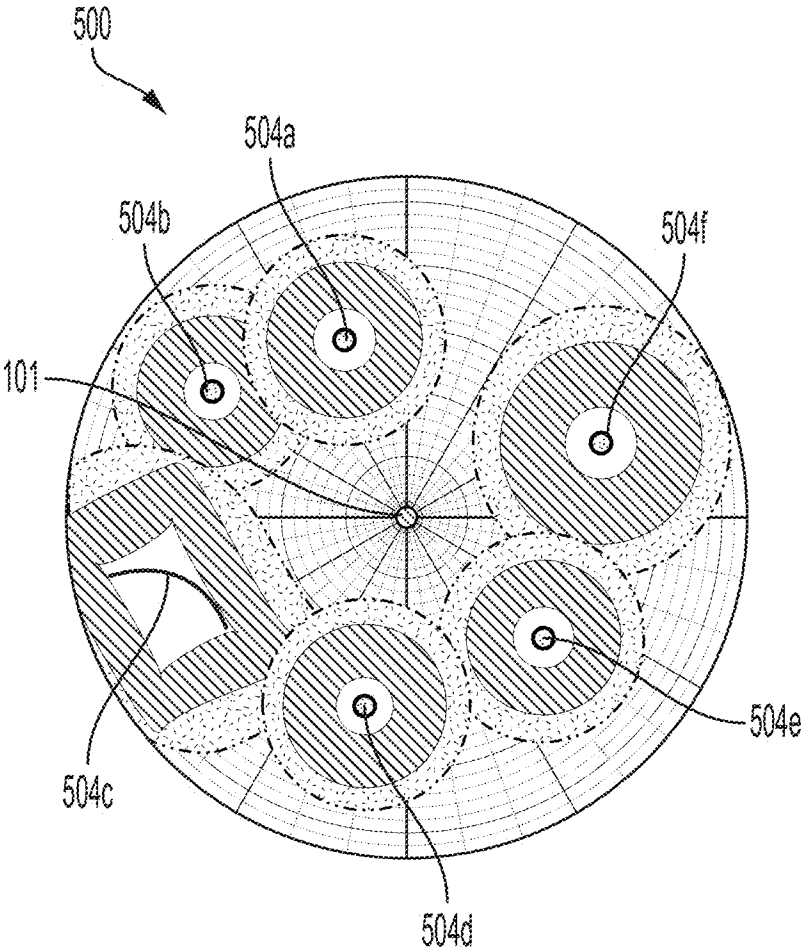
FIG. 5A is an example of a set of error ellipses for a set of offset wells in a subterranean formation.

FIG. 5A is an example of a set of error ellipses 500 for a set of offset wells in a subterranean formation 102, and FIG. 5B is an example of boundary lines 502 automatically generated, based on the error ellipses 500, for a reference well 101 in the subterranean formation 102 according to one example of the present disclosure. As illustrated in FIG. 5A, the error ellipses 500 include error ellipses for five offset wells 504*a-e*. Other suitable number of error ellipses for offset wells may be included in the error ellipses 500 for determining the boundary lines. The error ellipses 500 may be determined by calculating a certain radius around each offset well 504. The computing device 140 may determine the radius based on user input that includes a threshold level of risk for the drilling operation. The computing device 140 may adjust the radius based on uncertainty of the offset wells 504. As illustrated, the error ellipses 500 are circular and unadjusted, but in other examples, the computing device 140 may adjust the error ellipses 500 to be other suitable ellipse-like shapes based on the adjustment. The error ellipses 500 may be located around the reference well 101 that may include the wellbore 118 being formed by the drilling operation.

The computing device 140 may determine the boundary lines 502 of FIG. 5B based on the error ellipses 500 displayed in FIG. 5A. The computing device 140 may determine the boundary lines 502 by concatenating or otherwise combining the error ellipses 500. In some examples, the error ellipses 500 overlap with one another. In these examples, the boundary lines 502 may represent a single, continuous shape. In other examples, no error ellipses 500 may overlap, and in these examples, the boundary lines simply contain the error ellipses 500 without forming a continuous shape. The boundary lines 502 may include sharp corners. The computing device 140 may execute at least one algorithm on the boundary lines 502, and the at least one algorithm may include the smoothing algorithm, the tapering algorithm 212, and the like. The smoothing algorithm may allow the computing device 140 to replace the sharp corners with smooth arcs that may allow more realistic trajectories to be achieved. The tapering algorithm 212 may allow the computing device 140 to anticipate newly appearing offset wells as the drilling operation progresses and may allow the computing device 140 to adjust the trajectory or speed of the drilling operation before a collision with the newly appearing offset wells occurs.

The computing device 140 may receive a traveling plot associated with the drilling operation. The traveling plot may include the offset wells 504 that may include a set of trajectories associated with the offset wells 504. The traveling plot may additionally include the reference well 101 that the drilling operation may be forming. The computing device 140 may generate the error ellipses 500 around each offset well 504. The error ellipses 500 may be determined by the computing device 140 using measuring device uncertainty values, user-input anti-collision risk policies, or other suitable inputs for determining the error ellipses 500. The error ellipses 500 may indicate a range of possible collision risks when drilling or otherwise forming the reference well 101 near one of the offset wells 504. For example, if one error ellipse around one offset well 504 includes a radius of twenty feet, forming the reference well 101 five feet from the offset well 504 may involve a higher risk than forming the reference well 101 fifteen feet from one offset well 504 that may involve a higher risk than forming the reference well 101 thirty feet from the one offset well 504.

The computing device 140 may generate initial boundary lines for the drilling operation. The computing device 140 may combine the error ellipses 500 to generate the initial boundary lines. The initial boundary lines may be similar or identical to the boundary lines 502 of FIG. 5B. In some examples, the initial boundary lines may be used by the drilling operation as a guide or as a check during monitoring of the drilling operation. The initial boundary lines may indicate that forming the reference well 101 within the initial boundary lines may be safe and that risk of collision within the initial boundary lines may be mitigated enough for some users to proceed with the drilling operation. The computing device 140 may execute the smoothing algorithm on the initial boundary lines. The smoothing algorithm may allow the computing device 140 to replace the sharp corners with smooth arcs that may allow more realistic trajectories to be used by the drilling operation. Subsequent to executing the smoothing algorithm, the computing device 140 may output the boundary lines 502 for controlling the drilling operation. In other examples, the computing device 140 may assign a confidence level among the boundary lines 502 formed from executing the smoothing algorithm. The confidence level may include different levels of confidence or of trajectory risks that are described with respect to FIG. 6 and that may relate to forming the reference well 101 at corresponding locations.

Figure 6:
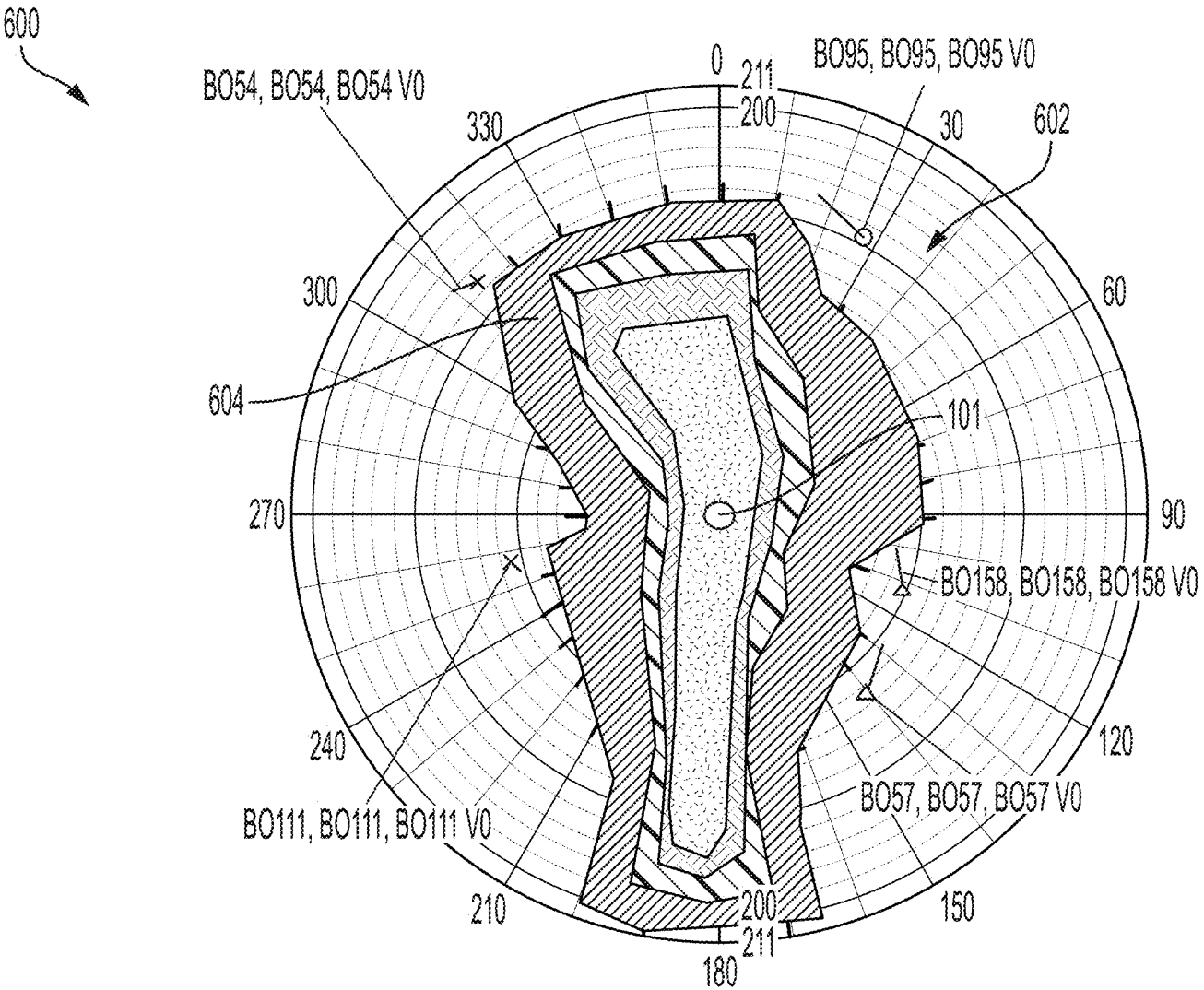
FIG. 6 is an example of a plot including boundary lines and a reference well according to one example of the present disclosure.

FIG. 6 is an example of a plot 600 including boundary lines 602 and a reference well 101 according to one example of the present disclosure. As illustrated, the plot 600 includes the boundary lines 602, the reference well 101, and a set of trajectory risks 604. The plot 600 may include other suitable components for displaying information relating to the boundary lines 602. The boundary lines 602 may be similar or identical to the boundary lines 502 of FIG. 5 and may be determined in a manner similar or identical to the block 306 of the process 300. The boundary lines 602 may vary based on a level of risk associated with the drilling operation. The level of risk may be determined by the computing device 140 based on user input or other suitable inputs and may depend on the individual or entity operating the drilling operation. For example, a certain entity operating the drilling operation may believe that high risk is allowable, and, as such, the boundary lines 602 for the certain entity may include a larger area compared to a different entity that chooses a low risk drilling operation. The trajectory risks 604 may show varying well trajectories with associated varying collision risks associated with the varying well trajectories.

In some aspects, systems, methods, and non-transitory computer-readable mediums for automatically generating boundary lines for controlling a drilling operation are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processor; and a non-transitory computer-readable medium comprising instructions that are executable by the processor to cause the processor to perform operations comprising: receiving data including a plurality of offset well surveys, measuring instrument information, and a well casing diameter, about a plurality of offset wells in a subterranean formation; determining, for each interval in a plurality of intervals along a trajectory of a reference well, reference well values; generating a plurality of boundary lines for the plurality of offset wells based on the received data and the determined reference well values; adjusting the plurality of boundary lines; and outputting the adjusted plurality of boundary lines for controlling a drilling operation.

Example 2 is the system of example 1, wherein the reference well is a wellbore being formed by the drilling operation, and wherein the reference well values include a center-to-center distance, at least one tool-face angle, a reference-well casing diameter, and a survey uncertainty.

Example 3 is the system of example 1, wherein the operation of generating a plurality of boundary lines for the plurality of offset wells based on the received data and the determined reference well values includes generating, for each interval of the plurality of intervals, a plurality of boundary lines around each offset well of the plurality of offset wells based on the received data and the determined reference well values.

Example 4 is the system of example 1, wherein the operation of adjusting the boundary lines includes: executing a smoothing algorithm on the plurality of boundary lines; and executing a tapering algorithm on the plurality of boundary lines for anticipating newly detected offset wells along the trajectory of the reference well.

Example 5 is the system of any of examples 1 and 4, wherein the operation of executing the tapering algorithm on the plurality of boundary lines includes: receiving a depth interval that includes a first subset of the plurality of boundary lines, wherein the depth interval is included in the plurality of intervals; determining a tool-face angle associated with the first subset of the plurality of boundary lines for the depth interval; and at a previous, adjacent depth interval that includes a second subset of boundary lines: adjusting the second subset of boundary lines by a predetermined percentage using the tool-face angle; and determining whether at least one offset well exists within the adjusted second subset of boundary lines.

Example 6 is the system of example 1, wherein the operation of generating the plurality of boundary lines for the plurality of offset wells based on the received data and the determined reference well values includes generating the plurality of boundary lines by combining a plurality of error ellipses, wherein the plurality of error ellipses are generated around a plurality of offset wells based on the reference well values and uncertainty values of the measuring instrument information.

Example 7 is the system of example 1, wherein the operation of generating the plurality of boundary lines for the plurality of offset wells based on the received data and the determined reference well values includes generating the plurality of boundary lines based on a level of acceptable risk designated by a user.

Example 8 is a method comprising: receiving data including a plurality of offset well surveys, measuring instrument information, and a well casing diameter, about a plurality of offset wells in a subterranean formation; determining, for each interval in a plurality of intervals along a trajectory of a reference well, reference well values; generating a plurality of boundary lines for the plurality of offset wells based on the received data and the determined reference well values; adjusting the plurality of boundary lines; and outputting the adjusted plurality of boundary lines for controlling a drilling operation.

Example 9 is the method of example 8, wherein the reference well is a wellbore being formed by the drilling operation, and wherein the reference well values include a center-to-center distance, at least one tool-face angle, a reference-well casing diameter, and a survey uncertainty.

Example 10 is the method of example 8, wherein the operation of generating a plurality of boundary lines for the plurality of offset wells based on the received data and the determined reference well values includes generating, for each interval of the plurality of intervals, a plurality of boundary lines around each offset well of the plurality of offset wells based on the received data and the determined reference well values.

Example 11 is the method of example 8, wherein the operation of adjusting the boundary lines includes: executing a smoothing algorithm on the plurality of boundary lines; and executing a tapering algorithm on the plurality of boundary lines for anticipating newly detected offset wells along the trajectory of the reference well.

Example 12 is the method of any of examples 8 and 11, wherein the operation of executing a tapering algorithm on the plurality of boundary lines includes: receiving a depth interval that includes a first subset of the plurality of boundary lines, wherein the depth interval is included in the plurality of intervals; determining a tool-face angle associated with the first subset of the plurality of boundary lines for the depth interval; and at a previous, adjacent depth interval that includes a second subset of boundary lines: adjusting the second subset of boundary lines by a predetermined percentage using the tool-face angle; and determining whether at least one offset well exists within the adjusted second subset of boundary lines.

Example 13 is the method of example 8, wherein generating the plurality of boundary lines for the plurality of offset wells based on the received data and the determined reference well values includes generating the plurality of boundary lines by combining a plurality of error ellipses, wherein the plurality of error ellipses are generated around a plurality of offset wells based on the reference well values and uncertainty values of the measuring instrument information.

Example 14 is the method of example 8, wherein generating the plurality of boundary lines for the plurality of offset wells based on the received data and the determined reference well values includes generating the plurality of boundary lines based on a level of acceptable risk designated by a user.

Example 15 is a non-transitory computer-readable medium comprising instructions that are executable by a processing device for causing the processing device to perform operations comprising: receiving data including a plurality of offset well surveys, measuring instrument information, and a well casing diameter, about a plurality of offset wells in a subterranean formation; determining, for each interval in a plurality of intervals along a trajectory of a reference well, reference well values; generating a plurality of boundary lines for the plurality of offset wells based on the received data and the determined reference well values; adjusting the plurality of boundary lines; and outputting the adjusted plurality of boundary lines for controlling a drilling operation.

Example 16 is the non-transitory computer-readable medium of example 15, wherein the reference well is a wellbore being formed by the drilling operation, and wherein the reference well values include a center-to-center distance, at least one tool-face angle, a reference-well casing diameter, and a survey uncertainty.

Example 17 is the non-transitory computer-readable medium of example 15, wherein the operation of generating a plurality of boundary lines for the plurality of offset wells based on the received data and the determined reference well values includes generating, for each interval of the plurality of intervals, a plurality of boundary lines around each offset well of the plurality of offset wells based on the received data and the determined reference well values.

Example 18 is the non-transitory computer-readable medium of example 15, wherein the operation of adjusting the boundary lines includes: executing a smoothing algorithm on the plurality of boundary lines; and executing a tapering algorithm on the plurality of boundary lines for anticipating newly detected offset wells along the trajectory of the reference well.

Example 19 is the non-transitory computer-readable medium of any of examples 15 and 18, wherein the operation of executing a tapering algorithm on the plurality of boundary lines includes: receiving a depth interval that includes a first subset of the plurality of boundary lines, wherein the depth interval is included in the plurality of intervals; determining a tool-face angle associated with the first subset of the plurality of boundary lines for the depth interval; and at a previous, adjacent depth interval that includes a second subset of boundary lines: adjusting the second subset of boundary lines by a predetermined percentage using the tool-face angle; and determining whether at least one offset well exists within the adjusted second subset of boundary lines.

Example 20 is the non-transitory computer-readable medium of example 15, wherein the operation of generating the plurality of boundary lines for the plurality of offset wells based on the received data and the determined reference well values includes generating the plurality of boundary lines by combining a plurality of error ellipses, wherein the plurality of error ellipses are generated around a plurality of offset wells based on the reference well values and uncertainty values of the measuring instrument information, and wherein the operation of generating the plurality of boundary lines for the plurality of offset wells based on the received data and the determined reference well values includes generating the plurality of boundary lines based on a level of acceptable risk designated by a user.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable medium comprising instructions that are executable by the processor to cause the processor to perform operations comprising:

receiving data including a plurality of offset well surveys, measuring instrument information, and a well casing diameter, about a plurality of offset wells in a subterranean formation;

determining, for each interval in a plurality of intervals along a trajectory of a reference well, reference well values;

generating a plurality of boundary lines for the plurality of offset wells based on the received data and the determined reference well values, the plurality of boundary lines usable to adjust a trajectory of a drilling operation for forming a wellbore within the plurality of boundary lines;

adjusting the plurality of boundary lines by:

determining a tool-face angle associated with a first subset of the plurality of boundary lines for a particular depth interval; and at a previous, adjacent depth interval that includes a second subset of boundary lines, adjusting the second subset of boundary lines by a predetermined percentage using the tool-face angle associated with the first subset of the plurality of boundary lines; and controlling a drilling operation using the adjusted plurality of boundary lines.

2. The system of claim 1, wherein the reference well is the wellbore being formed by the drilling operation, and wherein the reference well values include a center-to-center distance, at least one tool-face angle, a reference-well casing diameter, and a survey uncertainty.

3. The system of claim 1, wherein the operation of generating a plurality of boundary lines for the plurality of offset wells based on the received data and the determined reference well values includes generating, for each interval of the plurality of intervals, a plurality of boundary lines around each offset well of the plurality of offset wells based on the received data and the determined reference well values.

4. The system of claim 1, wherein the operation of adjusting the boundary lines includes:

executing a smoothing algorithm on the plurality of boundary lines; and executing a tapering algorithm on the plurality of boundary lines for anticipating newly detected offset wells along the trajectory of the reference well.

5. The system of claim 4, wherein the operation of executing the tapering algorithm on the plurality of boundary lines includes:

receiving a depth interval that includes the first subset of the plurality of boundary lines, wherein the depth interval is included in the plurality of intervals; and at the previous, adjacent depth interval:

determining whether at least one offset well exists within the adjusted second subset of boundary lines.

6. The system of claim 1, wherein the operation of generating the plurality of boundary lines for the plurality of offset wells based on the received data and the determined reference well values includes generating the plurality of boundary lines by combining a plurality of error ellipses, wherein the plurality of error ellipses are generated around a plurality of offset wells based on the reference well values and uncertainty values of the measuring instrument information.

7. The system of claim 1, wherein the operation of generating the plurality of boundary lines for the plurality of offset wells based on the received data and the determined reference well values includes generating the plurality of boundary lines based on a level of acceptable risk designated by a user.

8. A method comprising:

receiving data including a plurality of offset well surveys, measuring instrument information, and a well casing diameter, about a plurality of offset wells in a subterranean formation;

determining, for each interval in a plurality of intervals along a trajectory of a reference well, reference well values;

generating a plurality of boundary lines for the plurality of offset wells based on the received data and the determined reference well values, the plurality of boundary lines used to adjust a trajectory of a drilling operation for forming a wellbore within the plurality of boundary lines;

adjusting the plurality of boundary lines by:

determining a tool-face angle associated with a first subset of the plurality of boundary lines for a particular depth interval; and at a previous, adjacent depth interval that includes a second subset of boundary lines, adjusting the second subset of boundary lines by a predetermined percentage using the tool-face angle associated with the first subset of the plurality of boundary lines; and controlling a drilling operation using the adjusted plurality of boundary lines.

9. The method of claim 8, wherein the reference well is the wellbore being formed by the drilling operation, and wherein the reference well values include a center-to-center distance, at least one tool-face angle, a reference-well casing diameter, and a survey uncertainty.

10. The method of claim 8, wherein the operation of generating a plurality of boundary lines for the plurality of offset wells based on the received data and the determined reference well values includes generating, for each interval of the plurality of intervals, a plurality of boundary lines around each offset well of the plurality of offset wells based on the received data and the determined reference well values.

11. The method of claim 8, wherein the operation of adjusting the boundary lines includes:

executing a smoothing algorithm on the plurality of boundary lines; and executing a tapering algorithm on the plurality of boundary lines for anticipating newly detected offset wells along the trajectory of the reference well.

12. The method of claim 11, wherein the operation of executing a tapering algorithm on the plurality of boundary lines includes:

receiving a depth interval that includes the first subset of the plurality of boundary lines, wherein the depth interval is included in the plurality of intervals; and at the previous, adjacent depth interval:

determining whether at least one offset well exists within the adjusted second subset of boundary lines.

13. The method of claim 8, wherein generating the plurality of boundary lines for the plurality of offset wells based on the received data and the determined reference well values includes generating the plurality of boundary lines by combining a plurality of error ellipses, wherein the plurality of error ellipses are generated around a plurality of offset wells based on the reference well values and uncertainty values of the measuring instrument information.

14. The method of claim 8, wherein generating the plurality of boundary lines for the plurality of offset wells based on the received data and the determined reference well values includes generating the plurality of boundary lines based on a level of acceptable risk designated by a user.

15. A non-transitory computer-readable medium comprising instructions that are executable by a processing device for causing the processing device to perform operations comprising:

receiving data including a plurality of offset well surveys, measuring instrument information, and a well casing diameter, about a plurality of offset wells in a subterranean formation;

determining, for each interval in a plurality of intervals along a trajectory of a reference well, reference well values;

generating a plurality of boundary lines for the plurality of offset wells based on the received data and the determined reference well values, the plurality of boundary lines usable to adjust a trajectory of a drilling operation for forming a wellbore within the plurality of boundary lines;

adjusting the plurality of boundary lines by:

determining a tool-face angle associated with a first subset of the plurality of boundary lines for a particular depth interval; and at a previous, adjacent depth interval that includes a second subset of boundary lines, adjusting the second subset of boundary lines by a predetermined percentage using the tool-face angle associated with the first subset of the plurality of boundary lines; and controlling a drilling operation using the adjusted plurality of boundary lines.

16. The non-transitory computer-readable medium of claim 15, wherein the reference well is the wellbore being formed by the drilling operation, and wherein the reference well values include a center-to-center distance, at least one tool-face angle, a reference-well casing diameter, and a survey uncertainty.

17. The non-transitory computer-readable medium of claim 15, wherein the operation of generating a plurality of boundary lines for the plurality of offset wells based on the received data and the determined reference well values includes generating, for each interval of the plurality of intervals, a plurality of boundary lines around each offset well of the plurality of offset wells based on the received data and the determined reference well values.

18. The non-transitory computer-readable medium of claim 15, wherein the operation of adjusting the boundary lines includes:

executing a smoothing algorithm on the plurality of boundary lines; and executing a tapering algorithm on the plurality of boundary lines for anticipating newly detected offset wells along the trajectory of the reference well.

19. The non-transitory computer-readable medium of claim 18, wherein the operation of executing a tapering algorithm on the plurality of boundary lines includes:

receiving a depth interval that includes the first subset of the plurality of boundary lines, wherein the depth interval is included in the plurality of intervals; and at the previous, adjacent depth interval:

determining whether at least one offset well exists within the adjusted second subset of boundary lines.

20. The non-transitory computer-readable medium of claim 15, wherein the operation of generating the plurality of boundary lines for the plurality of offset wells based on the received data and the determined reference well values includes generating the plurality of boundary lines by combining a plurality of error ellipses, wherein the plurality of error ellipses are generated around a plurality of offset wells based on the reference well values and uncertainty values of the measuring instrument information, and wherein the operation of generating the plurality of boundary lines for the plurality of offset wells based on the received data and the determined reference well values includes generating the plurality of boundary lines based on a level of acceptable risk designated by a user.

* * * * *